US010024343B2

(12) United States Patent
Biwersi et al.

(10) Patent No.: US 10,024,343 B2
(45) Date of Patent: Jul. 17, 2018

(54) CONNECTING APPARATUS

(71) Applicant: HYDAC TECHNOLOGY GMBH, Sulzbach/Saar (DE)

(72) Inventors: Sascha Alexander Biwersi, Mettlach (DE); Marcus Hettiger, Saarlouis (DE); Christoph Stoenner, St. Ingbert (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 18 days.

(21) Appl. No.: 15/318,389

(22) PCT Filed: Jun. 2, 2015

(86) PCT No.: PCT/EP2015/001118
§ 371 (c)(1),
(2) Date: Dec. 13, 2016

(87) PCT Pub. No.: WO2015/188920
PCT Pub. Date: Dec. 17, 2015

(65) Prior Publication Data

US 2017/0122344 A1 May 4, 2017

(30) Foreign Application Priority Data

Jun. 13, 2014 (DE) ..... 10 2014 008 648

(51) Int. Cl.
*F15B 13/02* (2006.01)
*F15B 13/08* (2006.01)
*F15B 13/00* (2006.01)

(52) U.S. Cl.
CPC ..... *F15B 13/02* (2013.01); *F15B 13/08* (2013.01); *F15B 2013/002* (2013.01)

(58) Field of Classification Search
CPC ..... F15B 13/02; F15B 2013/002
See application file for complete search history.

(56) References Cited

U.S. PATENT DOCUMENTS 4,744,542 A * 5/1988 Heusser ..... F15B 13/02 251/30.01
6,397,880 B1 6/2002 Stoll et al.
2007/0295401 A1 12/2007 Okumura et al.

FOREIGN PATENT DOCUMENTS

AT 367 526 7/1982
CH 508 828 6/1971
(Continued)

OTHER PUBLICATIONS

International Search Report (ISR) dated Sep. 30, 2015 in International (PCT) Application No. PCT/EP2015/001118.

*Primary Examiner* — Kevin Lee
(74) *Attorney, Agent, or Firm* — Wenderoth, Lind & Ponack, L.L.P.

(57) ABSTRACT

A connecting apparatus connects to a main component (10) having a plurality of mutually adjacent fluid passage points (P'1, P'2, P'3, P'n . . . P'x). The connecting apparatus has a main body (12) controlling a fluid flow by a valve. A plurality of further fluid passage points (P1, P2, P3, Pn . . . Px) can be connected to each other in a fluid-conducting manner via the functional component (14) with assignable fluid passage points in the main component (10). One shut-off part, which shuts off the respective fluid passage point (P'2, P'3, P'n . . . P'x−1) in the main component (10) and/or in the fluid passage point remains unaffected by the functional component (14). In each case a fluid-conducting connection line (30, 32) is inside the main body (12) between the further fluid passage points (P1, P2, P3, Pn . . . Px) and the functional component (14) and can be shut off by a separate shut-off part, as long as the associated connection to the functional component (14) remains unused.

31 Claims, 2 Drawing Sheets

(56) References Cited

FOREIGN PATENT DOCUMENTS

| | | |
|---|---|---|
| DE | 28 16 502 | 10/1978 |
| DE | 42 04 416 | 10/1992 |
| DE | 41 20 300 | 12/1992 |
| DE | 690 02 444 | 11/1993 |
| DE | 200 13 360 | 10/2001 |
| EP | 0 955 473 | 11/1999 |
| EP | 2 472 163 | 7/2012 |

* cited by examiner

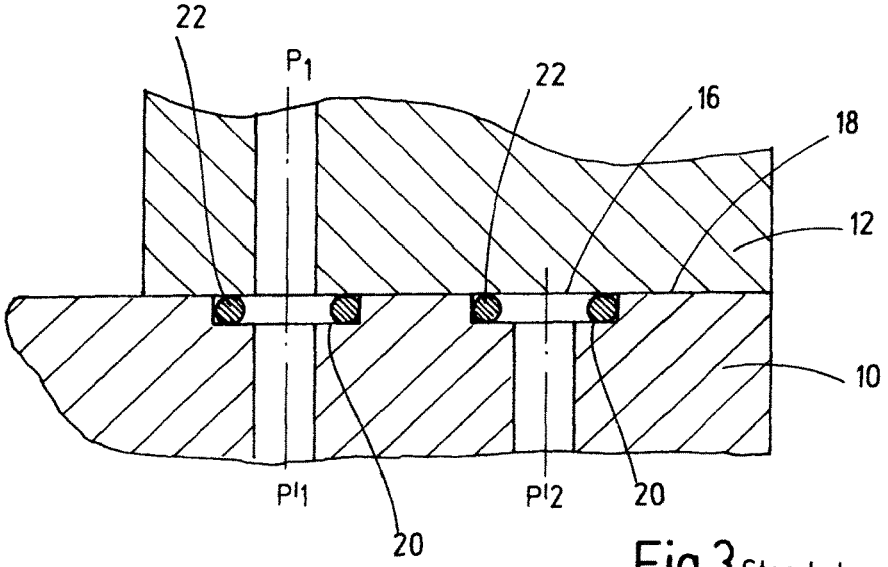
Fig.3 Stand der Technik
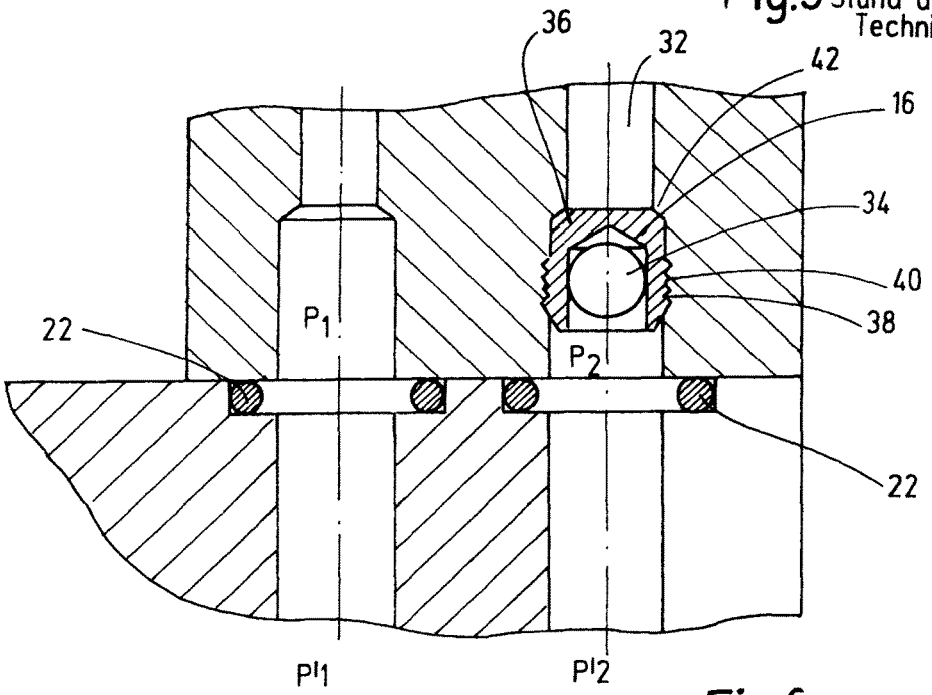
Fig.6
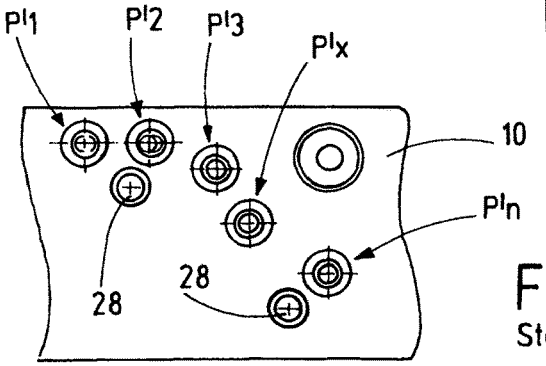
Fig.7
Stand der Technik

CONNECTING APPARATUS

FIELD OF THE INVENTION

The invention relates to a connection device for the fluidic connection to at least one main component having multiple mutually adjacent fluid passage points and including

- a main body that controls a fluid flow by at least one functional component, such as a valve device,
- multiple additional fluid passage points fluidically connectable to each other via the functional component with assignable fluid passage points in the main component, and
- at least one shut-off part, which shuts off the respective fluid passage point in the main component and/or in the main body, the fluid passage point remaining unaffected by the functional component.

BACKGROUND OF THE INVENTION

This prior art solution is explained in greater detail in the specific description. The known solution can only ever fluidically connect the functional component, for example, in the form of a 2/2 directional control valve, on both its input side and on its output side to one assignable fluid passage point, respectively, in the main body.

However, in order nevertheless to be able to provide a certain modularity in the sense of an LS (load sensitive) control valve assembly unit for mobile work machines, multiple fluid passage points mutually adjacent or assigned in groups to one another were provided in the fluid-supplying main component. The fluid passage points, depending on the number of fluid passage points in the main component to be managed or controlled, must then each be combined with a separate main body. The separate main body always has the same functional component and always has the same fluidic line in the area of its output to the last fluid passage point in the main component. An independent fluid line is then required for each fluid passage point to be controlled on the input side of the functional component, which is not applicable universally, but rather is always assigned to only one particular fluid passage in the main component. Simply put, if one wanted to manage four fluid passage points in the main component with one functional component by the main body, a total of four different main bodies would also have to be provided, each with an independent fluid feed line on the input side of the functional component, in order if necessary, to fluidically control any one of the four fluid passage points in the main component. The passage points or fluid connections otherwise remaining open in the main component that are not required are then covered by the housing wall of the main body, at which point a seal is preferably disposed to achieve a sealing, reliable closure to the surroundings in the area of the shut-off assembly.

SUMMARY OF THE INVENTION

An object of the invention is to provide an improved solution where the modularity of the overall connecting device is increased in a cost-effective and functionally reliable manner, while maintaining its advantages, such as providing a secure connecting geometry.

This object is basically achieved with a connection device having each fluidic connecting line that may be shut off by a separate shut-off part if the connection to the functional component remains unused and that exists within the base body between the additional fluid passage points and the functional component. Each additional fluid passage point in the main body may be individually assigned a shut-off part, so that the fluidic line in the main body that is required or not required, may be arbitrarily opened or shut off to be able to connect the functional component to the assignable fluid-supplying fluid passage point in the main component in a functionally reliable manner. This technical solution as such has no equivalent in the prior art. A plurality of connection geometries can be managed in a functionally reliable manner with only one type of main body having a minimum number of required components. That arrangement helps to reduce the costs of the solution.

As a result of the shut-off parts, designed preferably in the manner of ball expanders insertable preferably into the respective lengths of the unneeded connecting lines, each unneeded connecting line can be reliably shut off in the main body to the functional component. In terms of the sealing connection established, depending on the purposes the connection device according to the invention is to be used, additional sealing devices on the part of the main body, such as O-ring seals, which sealing devices are in principle susceptible to failure, can be omitted to reduce costs.

The connection device solution according to the invention is particularly suitable for controlling channels and channel connections, preferably in the form of control lines, for example, in the form of LS lines in control blocks of mobile work tools and work machines, which are readily charged with pressures up to approximately 400 bar. The connecting length disposed on the output side of the functional component as part of a connecting line may be provided as a direct tank connection to the main component. It may also serve as a continuing control line in the high pressure area if multiple connection devices and their components are overtly assembled to form functional groups.

Both the main component as well as the main body are preferably designed as valve blocks or flange blocks, which can be detachably connected to one another, for example, by a screw fitting.

The subject matter of the invention is also a system of a main body designed preferably as a common part and a main component, as presented in greater detail above.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure:

FIG. 3 is a partial side view in section of a connection solution in the prior art;

FIG. 6 is a partial side view in section of the connection solution of FIGS. 4 and 5A-5D; and FIG. 7 is a top view of a basic component in the prior art having multiple mutually adjacent fluid passage points.

DETAILED DESCRIPTION OF THE INVENTION

Figures 1, 2A, 2B, 2C, 2D, 4, 5A, 5B, 5C, 5D:
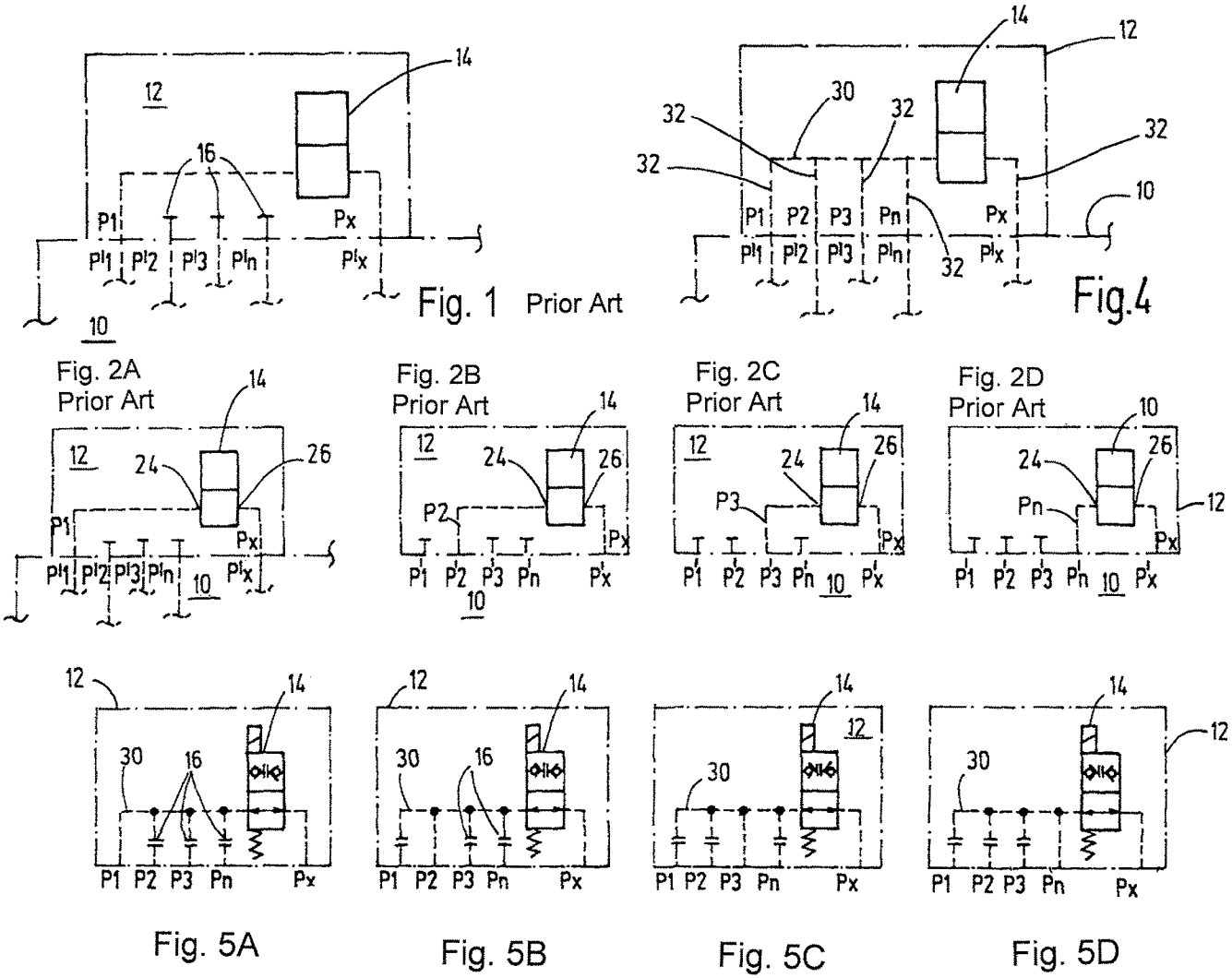
Fig. 1 Prior Art
Fig. 2A Prior Art
Fig. 2B Prior Art
Fig. 2C Prior Art
Fig. 2D Prior Art
FIGS. 1 and 2A-2D show connection solutions, in the form of hydraulic block diagrams, in the prior art.
FIGS. 4 and 5A-5D are block diagrams of a connection device according to an exemplary embodiment of the invention with basic application variants.

FIGS. 1 and 2A-2D show complete system connection solutions, in the form of hydraulic block diagrams, in the prior art. The connection device shown is for the fluidic connection to at least one main component 10, which has multiple mutually adjacent fluid passage points $P'_1$, $P'_2$, $P'_3$, $P'_n$ . . . $P'_x$. In addition to the main component 10, the connection device has a main body 12, which includes at least one functional component 14 for controlling a fluid flow to be conducted. The functional component 14 may be, for example, a valve device, preferably in the form of a 2/2 directional control valve, a switch valve or of some other valve device or some other hydraulic functional group such as, a diaphragm, choke or the like. The main body 12 according to the depiction of FIG. 1 further includes two additional fluid passage points $P_1$ and $P_x$, which may be fluidically connected via the functional component 14 to the correspondingly assigned fluid passage points $P'_1$ and $P'_x$ in the main component 10. In addition, a shut-off part 16 is present (in this regard, see also FIG. 3), which shuts off the respective fluid passage points $P'_1$, $P'_2$, $P'_3$, $P'_n$ . . . $P'_{x-1}$ in the main component 10, so that these passage points remain unaffected by the functional component 14.

The main component 10 as well as the main body 12 are designed in the form of valve blocks or flange blocks, which can be connected to one another in a flange manner to form a complete system. In each connected state according to the depictions of FIGS. 1 through 3, the lower housing wall 18 of the flange-shaped main body 12 forms the shut-off part 16, which covers the fluid passage points $P'_1$, $P'_2$, $P'_3$, $P'_n$ . . . $P'_{x-1}$ in a blocking manner. In addition, a fluidic connection according to the depictions of FIGS. 1 and 3 is established between the fluid passage point $P'_1$ in the main component 10 and the additional fluid passage point $P_1$ in the main body 12. To achieve a sealed, closing connection between the main component 10 and the main body 12 in the area of the operational fluid passage points $P'_1$ and $P_1$, and to shut off fluid passage points $P'_2$, $P'_3$, $P'_n$ . . . $P'_{x-1}$, radial expansions 20 permit the insertion of a seal, preferably in the form of an O-ring seal 22, and are provided at the fluid passage points. Each O-ring seal 22 must be inserted, before the flange-shaped connection between the body 12 and the main component 10 is established. Thus, the respective seal opens in the form of the O-ring seal 22 with at least one part of its upper-lying outer contour on one flange side in the form of the lower housing wall 18 of the main body 12 out in the area of the assignable, additional fluid passage points $P'_1$, $P'_2$, $P'_3$, $P'_n$ . . . $P'_x$ in the connected state of the main body 12 and the main component 120, and is in sealing contact with this wall 18.

In the known solution, as illustrated in particular in FIGS. 2A-2D, an independent main body 12 must be provided for each possible controllable fluid passage point in the main component 10, which covers the fluid passage point. Thus, FIGS. 2A-2D show, as viewed from left to right, four different main bodies 12 with functional components 14. Each main body controls the assignable pairs of fluid passage points $P_1$, $P'_1$; $P_2$, $P'_2$; $P_3$, $P'_3$ and $P_n$, $P'_n$ from the connection geometry on the input side 24 of the functional component 14. The respective additional fluid passage point $P_x$ of the main body 12 opens into the assignable fluid passage point $P'_x$ in the main component 10 only on the output side 26 of the functional component 14. In this regard, another passage on the output side could be selected instead of the passage $P_x$, $P'_x$, such as, for example, a combination $P_{x-1}/P'_{x-1}$. Thus, according to the depiction of FIGS. 2A-2D, to control a total of four fluid passage points $P'_1$, $P'_2$, $P'_3$, and $P'_n$, a total of four different main bodies 12 are necessary, which main bodies are all similar and also provided inasmuch with the same reference numeral in FIGS. 2A-2D. Those main bodies nevertheless differ in the configuration of the internal fluidic piping and the connection geometry with respect to the additional fluid passage points $P_1$, $P_2$, $P_3$, $P_n$ . . . $P_x$.

The functionalities depicted in FIGS. 2A-2D can therefore be implemented by four different flange block processings with different main bodies 12. Disadvantageously, a total of four block variants differing from one another, depending on their intended use, must be controlled in terms of production technology and logistically, and temporarily stored. These additional tasks are intended to be avoided with the connection device solution according to the invention described below. For purposes of clarification, the respective aforementioned fluid passage points do not, as is shown in principle in FIGS. 1, 2, 4 and 5A-5D in a linear series arrangement, characterize the respective block diagram. Rather, they may also be easily arranged randomly distributed in groups, as indicated in FIG. 7 of the prior art, which shows a top view of the fluid connection diagram of a known main component 10 with the fluid passage points $P'_1$, $P'_2$, $P'_3$, $P'_n$ . . . $P'_x$. In addition, a portion of the screw fitting 28 is shown in FIG. 7, which screw fitting permits connecting main component 10 to main body 12 via a screw connection to achieve a mutual contact. The part of the screw fitting 28 according to the depiction of FIG. 7 relates to the engagement thread distances for connection screws not further depicted.

In the device solution according to the invention according to the depictions of FIGS. 4, 5 and 6, a central line 30 extends preferably horizontally in the main body 12, which central line replaces the previously variously disposed connecting lines in the flange-shaped main body 12. The functional component 14 is, in turn, connected in the central line 30, which, previously depicted in the form of a blackbox, is shown in FIGS. 5A-5D in the design of a 2/2 directional switch valve. That valve is controllable by an electromagnetic device, for example, in the form of a proportional solenoid, and is shown in FIGS. 5A-5D in the interconnected position. In addition, individual pipelines 32 are shown, which individual pipelines preferably establish the shortest connection in each case between the central line 30 and the respective assignable additional fluid passage points $P_1$, $P_2$, $P_3$, $P_n$ . . . $P_x$ and which preferably open out perpendicularly into the central line 30.

Thus, as indicated, in particular in FIG. 4, pairs of assignable fluid passage points $P_1$, $P'1$; $P_2$, $P'_2$; $P_3$, $P'_3$; $P_n$, $P'_n$ . . . $P_x$, $P'_x$ of main body 12 with main component 12 are implemented via the central line 30 and the individual connected pipelines 32. If, as is suggested by the depiction of FIG. 5A, for example, only one fluid passage point $P'_1$ is to be connected to the additional fluid passage point $P_1$, individual shut-off parts 16 are inserted separately from one another into the assignable pipelines 32, in order to thereby shut off the fluid passage points $P_2$, $P_3$, and $P_n$. If a fluidic passage via the fluid passage point pair $P_2$, $P'_2$ is to be implemented, the shut-off parts 16 are inserted into the pipelines 32 of $P_1$, $P_3$ and $P_n$ etc., according to the additional embodiments of FIGS. 5B-5C. In turn, nothing changes on the output side of the functional component 14 and the output pair $P_x$, $P'_x$ remains intact.

If, according to the depiction of FIG. 4, no shut-off parts 16 are inserted, the option exists of connecting in the manner outlined, in principle, all pairs of fluid passage points that are provided. Nor, for example, does the pressurized fluid connection need to be implemented by the main component 10 via the fluid passage points $P'_3$, $P'_n$ . . . $P'_{x-1}$. Instead, the option exists of implementing other connection concepts (not depicted) in the sense of looping on the input and output side via pairs of fluid passage points of main component 10 and main body 12. In principle, the option exists of feeding preferably pressurized fluid via the fluid passage point pair $P'_x$, $P_x$ to the main body 12, which then, after passing the connected functional component, in turn delivers the aforementioned fluid flow to the primarily positioned pair of fluid passage points. A variety of variation options are conceivable here with the connection concept according to the invention.

The excerpted detail of FIG. 6 shows a connection solution, as is depicted, for example, FIG. 5A, in which the passage point pair $P'_1$ and $P_1$ are fluidically connected to one another and the additional fluid passage points $P_2$, $P_3$, $P_n$ are shut off by a shut-off part 16. According to the depiction of FIG. 6, the shut-off part 16 is implemented in the form of a sealing plug, preferably in the form of a ball expander. The expander concept, based on the pressure or expansion principle, utilizes a ball 34 as an expansion element. The ball is guided in a pot-shaped, expandable holding sleeve 36. By pressing in the ball-shaped expansion element 34, a sleeve expansion is initiated with a backward-rolling gripping of the external teeth 38 surrounding the outer circumference of the holding sleeve 36 into the surrounding wall 40 that surrounds the pipeline 32, which pipeline opens downwardly, as seen in the viewing direction of FIG. 6, into the additional fluid passage point $P'_2$. The expansion process is considered completed once the apex of the ball disappears below the margin of the free, downwardly projecting sleeve upper edge. During the aforementioned deformation of the holding sleeve 36, the edge of the free inlet opening thereof constricts to a degree and to that extent secures the ball-shaped expansion elements 34 against loss.

The shut-off element solution depicted in FIG. 6 is self-sealing per se, so that the previously described and conventional O-ring seals 22 may also be omitted, at least in the area of the inserted shut-off parts 16. If one wishes to introduce the shut-off part 16 at another point inside another connecting length, as per the depictions of FIGS. 5B-5D, this task may be easily implemented by simply introducing the independent shut-off part 16 as a replicate component into the desired pipeline 32 to be used. To achieve a defined contact between the respective shut-off part 16 and the surrounding wall 40, a step-shaped expansion 42 may be provided in the wall 40, against which the bottom side of the shut-off part 16 may be supported for the expansion process described.

Thus, with the solution according to the invention, only one form of the main body 12 is needed to reliably manage a variety of possible fluid connections as part of the connection to a main component 10. In principle, if one wishes to accommodate sealing elements such as O-ring seals in a flange surface, here, that of the main component 10, the space available for this is usually severely limited. A significant disadvantage is that corresponding radial expansions 20 must be provided for accommodating the O-ring seals in order not to impede the fluid flow. If, as in FIG. 3, the mutually adjacent opposing flange surfaces of the main component 10 and main body 12 are sealed to the outside by the axially acting O-ring seals 22, the larger the diameter of the O-ring seal 22, the greater the forces become, which seek to lift the flange block 12 from the support plate of the main component 10 during fluid operation. For this reason, the effort must be made to design the operative surface of the O-ring seals 22 and, therefore, the dimension of the O-ring seals itself as small as possible. That small design has a detrimental effect on the sealing action. The sealing action in particular, is an important aspect specifically in the case of signal lines, since even minimal leakages distort pressures and may therefore cause control errors. Thus, in terms of process stability, a sealing in two fluid flow directions should be guaranteed.

Furthermore, the machining and assembly of the sealing element should be kept as simple as possible, in order not to jeopardize the fundamentally targeted economic advantage. The aforementioned ball expander solution for implementing the respective shut-off part 16 meets all of the requirements outlined above. The installation space required by the ball expander, as demonstrated, requires primarily only a small diameter offset 42. The aforementioned sealing solution may be physically acted upon even with high pressures without resulting in a malfunction. Furthermore, the shut-off part 16 in the form of the ball expander may be mounted and installed in the assignable pipelines 32 in a rapid and process-stable manner. This operation is not possible with the present sealing solutions, as they are shown, by way of example, in FIG. 3.

By using a universally drilled block, here in the form of the main body 12, and several sealing elements in the form of ball expanders functioning as shut-off parts 16, the block definition can implement a variety of hydraulic functionalities/logics, while including if applicable only two material numbers. Since the aforementioned block 12 is designed as a common part, the production costs are reduced to a significant extent. Furthermore, few components are required to be logistically controlled due to the common part characteristic. The assembly of the sealing plugs 16 may be optimally coordinated from a manufacturing perspective.

While one embodiment has been chosen to illustrate the invention, it will be understood by those skilled in the art that various changes and modifications can be made therein without departing from the scope of the invention as defined in the claims.

The invention claimed is:

1. A connection device for providing a fluidic connection, comprising:

a main component having multiple mutually adjacent component fluid passages therein;

a main body controlling a fluid flow therein by a flow controller therein;

multiple body fluid passages in said main body fluidically connectable to each other via said flow controller and fluidically connectable with assignable ones of said component fluid passages;

a fluidic connecting line in said main body extending between and connected to in fluid communication with said body fluid passages and said flow controller; and a first shut-off part located in at least one of said body fluid passages closing fluid flow therethrough while said one of said body fluid passages remains unaffected by said flow controller, said shut-off part being a sealing plug.

2. The connection device according to claim 1 wherein said sealing plug comprises a ball expander.

3. The connection device according to claim 1 wherein said connecting line opens outwardly from said main body via said body fluid passages, said shut off part being insertable from outside of said main body into the respective body fluid passage and retained therein.

4. The connection device according to claim 1 wherein said main body comprises a flange block and is connected in a flange manner to said main component to form a complete system.

5. The connection device according to claim 1 wherein each of said component fluid passages comprises a radial expansion on an end thereof facing said main body, each said radial expansion receiving a seal therein engaging said main body and said main component sealing a connection between said main body and main component.

6. The connection device according to claim 5 wherein each said seal comprises an outer contour opening on a flange side of said main body adjacent a respective one of said body fluid passages.

7. The connection device according to claim 1 wherein said body fluid passages extend perpendicularly from said connecting line to openings thereof on a surface of said main body facing said main component.

8. The connection device according to claim 1 wherein only one of said body fluid passages leads via said connecting line to an input side of said flow controller; and only one other one of said body fluid passages is connected to an output side of said flow controller via said connecting line.

9. The connection device according to claim 8 wherein said flow controller is connected to said connecting line on said output side thereof upstream of the other of said body fluid passages ultimately leading to an outer surface of said main body.

10. A connection device for providing a fluidic connection, comprising:

a main component having multiple mutually adjacent component fluid passages therein;

a main body controlling a fluid flow therein by a flow controller therein, said main body being a flange block and being connected in a flange manner to said main component to form a complete system;

multiple body fluid passages in said main body fluidically connectable to each other via said flow controller and fluidically connectable with assignable ones of said component fluid passages;

a fluidic connecting line in said main body extending between and connected to in fluid communication with said body fluid passages and said flow controller; and a first shut-off part located in at least one of said body fluid passages closing fluid flow therethrough while said one of said body fluid passages remains unaffected by said flow controller.

11. The connection device according to claim 10 wherein said connecting line opens outwardly from said main body via said body fluid passages, said shut off part being insertable from outside of said main body into the respective body fluid passage and retained therein.

12. The connection device according to claim 10 wherein each of said component fluid passages comprises a radial expansion on an end thereof facing said main body, each said radial expansion receiving a seal therein engaging said main body and said main component sealing a connection between said main body and main component.

13. The connection device according to claim 12 wherein each said seal comprises an outer contour opening on a flange side of said main body adjacent a respective one of said body fluid passages.

14. The connection device according to claim 10 wherein said body fluid passages extend perpendicularly from said connecting line to openings thereof on a surface of said main body facing said main component.

15. The connection device according to claim 10 wherein only one of said body fluid passages leads via said connecting line to an input side of said flow controller; and only one other one of said body fluid passages is connected to an output side of said flow controller via said connecting line.

16. The connection device according to claim 15 wherein said flow controller is connected to said connecting line on said output side thereof upstream of the other of said body fluid passages ultimately leading to an outer surface of said main body.

17. A connection device for providing a fluidic connection, comprising:

a main component having multiple mutually adjacent component fluid passages therein;

a main body controlling a fluid flow therein by a flow controller therein;

multiple body fluid passages in said main body fluidically connectable to each other via said flow controller and fluidically connectable with assignable ones of said component fluid passages, each of said component fluid passages having a radial expansion on an end thereof facing said main body, each said radial expansion receiving a seal therein engaging said main body and said main component sealing a connection between said main body and main component;

a fluidic connecting line in said main body extending between and connected to in fluid communication with said body fluid passages and said flow controller; and a first shut-off part located in at least one of said body fluid passages closing fluid flow therethrough while said one of said body fluid passages remains unaffected by said flow controller.

18. The connection device according to claim 17 wherein said connecting line opens outwardly from said main body via said body fluid passages, said shut off part being insertable from outside of said main body into the respective body fluid passage and retained therein.

19. The connection device according to claim 17 wherein each said seal comprises an outer contour opening on a flange side of said main body adjacent a respective one of said body fluid passages.

20. The connection device according to claim 19 wherein said flow controller is connected to said connecting line on said output side thereof upstream of the other of said body fluid passages ultimately leading to an outer surface of said main body.

21. A connection device for providing a fluidic connection, comprising:

a main component having multiple mutually adjacent component fluid passages therein;

a main body controlling a fluid flow therein by a flow controller therein;

multiple body fluid passages in said main body fluidically connectable to each other via said flow controller valve and fluidically connectable with assignable ones of said component fluid passages;

a fluidic connecting line in said main body extending between and connected to in fluid communication with said body fluid passages and said flow controller, only one of said body fluid passages leading via said connecting line to an input side of said flow controller, only one other one of said body fluid passages being connected to an output side of said flow controller via said connecting line; and a first shut-off part located in at least one of said body fluid passages closing fluid flow therethrough while said one of said body fluid passages remains unaffected by said flow controller.

22. The connection device according to claim 21 wherein said connecting line opens outwardly from said main body via said body fluid passages, said shut off part being insertable from outside of said main body into the respective body fluid passage and retained therein.

23. The connection device according to claim 21 wherein said valve is connected to said connecting line on said output side thereof upstream of the outer of said body fluid passages ultimately lading to an outer surface of said main body.

24. A connection device for providing a fluidic connection, comprising:

a main component having multiple mutually adjacent component fluid passages therein;

a main body controlling a fluid flow therein by a flow controller therein;

multiple body fluid passages points in said main body fluidically connectable to each other via said flow controller and fluidically connectable with assignable ones of said component fluid passages;

a central connecting line in said main body extending between and connected to in fluid communication with said body fluid passages and said flow controller, said body fluid passages extending individually directly from said central connecting line; and a first shut-off part located in at least one of said body fluid passages closing fluid flow therethrough while said one of said body fluid passages remains unaffected by said flow controller.

25. The connection device according to claim 24 wherein said central connecting line opens outwardly from said main body via said body fluid passages, said shut off part being insertable from outside of said main body into the respective body fluid passage and retained therein.

26. The connection device according to claim 24 wherein said main body comprises a flange block and is connected in a flange manner to said main component to form a complete system.

27. The connection device according to claim 24 wherein each of said component fluid passages comprises a radial expansion on an end thereof facing said main body, each said radial expansion receiving a seal therein engaging said main body and said main component sealing a connection between said main body and main component.

28. The connection device according to claim 27 wherein each said seal comprises an outer contour opening on a flange side of said main body adjacent a respective one of said body fluid passages.

29. The connection device according to claim 24 wherein said body fluid passages extend perpendicularly from said central connecting line to openings thereof on a surface of said main body facing said main component.

30. The connection device according to claim 24 wherein only one of said body fluid passages leads via said central connecting line to an input side of said flow controller; and only one other one of said body fluid passages is connected to an output side of said flow controller via said central connecting line.

31. The connection device according to claim 30 wherein said flow controller is connected to said central connecting line on said output side thereof upstream of the other of said body fluid passages ultimately leading to an outer surface of said main body.

* * * * *